US006457901B1

(12) United States Patent
Sondrup

(10) Patent No.: US 6,457,901 B1
(45) Date of Patent: Oct. 1, 2002

(54) ADJUSTABLE MANHOLE APPARATUS

(75) Inventor: Chris Sondrup, Lindon, UT (US)

(73) Assignee: Precision Cover Systems, Inc., Lindon, UT (US)

( * ) Notice: Subject to any disclaimer, the term of this patent is extended or adjusted under 35 U.S.C. 154(b) by 0 days.

(21) Appl. No.: 09/653,714

(22) Filed: Sep. 1, 2000

(51) Int. Cl.[7] ..... E02D 29/14
(52) U.S. Cl. ..... 404/26; 404/25
(58) Field of Search ..... 404/26, 25

(56) References Cited

U.S. PATENT DOCUMENTS

| | | | | | |
|---|---|---|---|---|---|
| 599,441 | A | | 2/1898 | Dorr | |
| 689,224 | A | | 12/1901 | Pillsbury | |
| 814,013 | A | | 3/1906 | Baumann | |
| 1,639,495 | A | * | 8/1927 | Frame | 404/26 |
| 3,215,052 | A | * | 11/1965 | Lindstad et al. | 404/26 |
| 3,858,998 | A | * | 1/1975 | Larsson et al. | 404/26 |
| 3,930,739 | A | * | 1/1976 | Larsson et al. | 404/26 |
| 4,197,031 | A | | 4/1980 | Hild | |
| 4,273,467 | A | | 6/1981 | Cronk | |
| 4,337,005 | A | | 6/1982 | LeBaron | |
| 4,614,065 | A | * | 9/1986 | Papp | 52/20 |
| 4,883,590 | A | | 11/1989 | Papp | |
| 5,044,674 | A | | 9/1991 | Hendrickson | |
| 5,051,022 | A | * | 9/1991 | Bowman | 404/26 |
| 5,143,478 | A | * | 9/1992 | Bowman | 404/26 |
| 5,165,819 | A | * | 11/1992 | Bowman | 404/26 |
| 5,211,504 | A | | 5/1993 | Trudel | |
| 5,360,131 | A | | 11/1994 | Phillipps et al. | |
| 5,366,317 | A | | 11/1994 | Solimar | |
| 5,451,119 | A | | 9/1995 | Hondulas | |
| 5,470,172 | A | | 11/1995 | Wiedrich | |
| 5,496,128 | A | | 3/1996 | Odill | |
| 5,513,926 | A | * | 5/1996 | Prescott | 404/26 |
| 5,564,855 | A | | 10/1996 | Anderson | |
| 5,634,739 | A | * | 6/1997 | Armstrong | 404/26 |
| 5,944,442 | A | * | 8/1999 | Roush et al. | 404/26 |
| 5,956,905 | A | | 9/1999 | Wiedrich | |
| 6,109,824 | A | * | 8/2000 | Annes | 404/26 |

* cited by examiner

*Primary Examiner*—Gary S. Hartmann
(74) *Attorney, Agent, or Firm*—Thorpe, North & Western

(57) ABSTRACT

A manhole access for sewers. More particularly, the present invention relates to a manhole that is adjustable in height and/or pitch to allow the top of the manhole top section to conform to the pitch of a surrounding surface, such as a road. Specifically, there is a cover, configured to cover access to the manhole extension, and an adjuster, coupled between the cover and the manhole extension, designed to be positioned in multiple positioned that form an angle of the cover relative to a top edge of the manhole extension. The adjuster has a cover coupler, positioned on a top side of thereof, designed to releasably hold the cover; and manhole extension coupler, positioned on a bottom edge thereof, designed to hold the adjuster proximate to the top edge of the manhole extension. The adjuster further includes a first position that provides for zero degrees of slope between the manhole cover and the top edge of the manhole extension; and a second position that provides for up to and including twenty degrees of slope between the manhole cover and the top edge of the manhole extension.

2 Claims, 1 Drawing Sheet

ADJUSTABLE MANHOLE APPARATUS

RELATED APPLICATIONS

The following related applications are currently pending: "Adjustable Floor Drain Apparatus", filed on Jun. 6, 2000, having Ser. No. 09/587,857, and "Adjustable Pipe Connector" filed on May 9, 2000, having Ser. No. 09/568,300, and "Adjustable Drain Apparatus" filed on May 8, 2000, having Ser. No. 09/566,548, all inventions having the same inventor, Chris Sondrup.

THE FIELD OF THE INVENTION

The present invention relates generally to street manholes. More particularly, the present invention relates to a manhole which is adjustable in pitch to allow the top of the cover to conform to the pitch of a surrounding surface, such as a road.

BACKGROUND ART

A manhole is an opening in any surface large enough to allow workmen to descend beneath the surface to obtain access to stored materials or equipment or underground installations. The openings are normally in areas carrying traffic so that a means of securely framing and covering the opening must be provided. The manholes must also be strong enough to withstand various external loadings, for example the loading of vehicles moving over the manhole.

In the prior art, the standard procedure has been to frame the opening with a grey iron casting. For example, D& L Supply, of 880 West 150 North, in Lindon, Utah 84042, sells various styles of manhole assemblies. These castings typically incorporate a flanged surface that rests on a supporting structure that is located under ground. This supporting structure typically comprises standard concrete rings long enough so that a number of them form a passage to reach the underground installation. The flanged surface of the manhole transmits the weight of the equipment, together with live surface loads, to the supporting structure. The frame typically incorporates a projecting ledge around the circumference and a cast iron cover rests on the ledge and closes the manhole. The cover is a removable casting designed to carry the surface loads, and must transmit those forces to the underground supporting structure through the frame. The cover must be heavy to avoid vandalism. In some cases it is bolted down in order to make the installation water tight and tamper proof.

In one situation, a subsequent layer of surfacing material (for example, asphalt) is added to the road surface. When this happens, the manhole may need to be adjusted to match the angle of the new road. Typically, adjustment is done by filling the space between the manhole top structure and the supporting manhole frame structure with layers of bricks and mortar. This is a manual, time-consuming procedure.

One patent which illustrates an adjustable manhole is U.S. Pat. No. 4,273,467 to Cronk. The device designed by Cronk is an adjustable manhole cover support. The support comprises an outer ring having a circular internal opening. Threaded members are disposed about the interior of the circular opening. An insert is dimensioned to fit within the outer ring to a depth controlled by the abutment of the insert against the threaded members. Studs engaged and extend through the threaded members to abut the under surface of the insert to provide control of the depth of the insert into the outer ring and the angulation of the outer ring. The support is simple to make, easy to adjust and trouble-free in operation.

U.S. Pat. No. 5,496,128 is an internal fastening band for an internal manhole chimney seal, as well as a means for expanding the band and a means for removing the band. One end of the band is narrower than the other end so that when overlapped the ends of the band nest into one another to form a continuous expansion band. The first end portion has a plurality of apertures longitudinally spaced along the fastening band, and a plurality of slots spaced between the apertures and an end of the fastening band. The second end portion also has an aperture along a tab for engaging one of the slots to connect the first end portion to the second end portion with the particular slot being selected to adjust the continuous circular fastening band to a desired diameter. A tool is described for engaging an aperture in each end portion to increase the diameter of the circular expansion band and force the resilient sleeve against the inside surface of the manhole. An attachment for this tool enabling the removal of this band is also disclosed.

A further related U.S. Pat. No. is 5,564,855, which discloses a stackable height adjustment ring for supporting a manhole cover frame upon a concrete manhole shaft liner that has a ring body that is formed from plastic resin. The ring includes inner and outer radially spaced apart side walls, and optionally, a top wall. Brace arms that are integral with the walls preferably extend radially between the walls for holding them together. The rings have alignment members, e.g., an inner wall of tiering may have an upwardly facing shoulder upon its upper edge and the outer wall, a downwardly facing shoulder on its lower edge. An upwardly extending cylindrical collar at the top of the outer ring fits the downwardly facing shoulder of an adjacent ring. There is also a downwardly extending collar at the lower end of the inner ring to fit on the upwardly facing shoulder of a similar inner ring. The alignment members enable each ring to be held in alignment upon each successive ring beneath it so that the rings can be stacked one upon another to adjust the elevation of the manhole cover frame above a concrete manhole shaft liner. Optionally, the rings have engageable ramps for adjusting the pitch of an upper one of two stacked rings.

A similar patent, U.S. Pat. No. 5,956,905, is a molded plastic extension member for use in increasing the height of manholes, or catch basins when surfacing or resurfacing a roadway. The extension member may be formed having a sloping upper planar support surface to thereby adjust the angle of the catch basin support frame or the manhole cover support frame. An outer surface of the extension member includes indicia that allows the user to align the slope of the upper planer support frame. An outer surface of the extension member includes indicia that allows the user to align the slope of the upper planar support surface parallel with the roadway surface. When several sloped extension members are stacked, the indicia may be used to create a complex angle of slope relative to the underlying base members vertical axis. The extension member includes a pocket adaptable for receiving and retaining mortar between two stacked extensions. Planar surfaces may extend from both the upper and lower edge of the extension member, thereby providing support and added stacking surface for the stacked extension members. The extension member also includes a tapered shoulder that interlocks with either the manhole cone, the catch-basin cone, or with other stackable angled plastic members.

Yet a further prior art patent, U.S. Pat. No. 4,337,005, is concerned with an apparatus for enabling extension or other leveling adjustment of manhole cover supporting structures and the like comprising extension spacer rings resiliently compressed in self-storing fashion adjacent a support sleeve portion of the supporting structure, and adapted to be faced downward from storage to expand into position below the sleeve to extend or adjust the level of the same.

Another manhole cover patent, U.S. Pat. No. 5,366,317, includes a collar defining an opening with an inner perimeter is provided with a pivotally mounted cover having an outer perimeter greater than the inner perimeter of the collar. A seal is provided to seal between the cover and the collar. Closure structure is provided to secure the free end of the cover to the collar. A threaded bolt is provided to close the cover. A pivotally mounted lever arm is mounted to the bolt for turning of the bolt. An adjustable threaded hinge is provided to adjust the cover in a longitudinal direction relative to the collar. The manhole cover apparatus is useable on pressure containers, such as those used to pneumatically handle particulate material.

U.S. Pat. No. 5,451,119, is a barrel-shaped manhole frame for receiving a manhole cover is provided with an inwardly directed peripheral flange at its lower end having circumferentially spaced, inclined grooves to receive wedges that can be driven in situ into surrounding earthwork to wedge the frame upwardly and thereby adjust its height and slope to conform with a roadway or sidewall surface under construction.

Additionally, U.S. Pat. No. 5,470,172, is a molded plastic extension member for use in increasing the height of manholes, or catch basins when surfacing or resurfacing a roadway is described. A wedge to adjust the angle of the catch basin support frame or the manhole cover support frame is also described. The extension includes a pocket for reducing the total surface area of the molded plastic member. It also includes a shoulder that interlocks with either the manhole cone, the catch basin cone, or with other stackable molded plastic members. The extension also contains a planer support surface which provides rigidity and support, and provides a surface for caulking to be applied to form a watertight seal.

Consequently, there is a need for an improved adjustable manhole top structure that will easily and quickly allow for angular adjustment of the manhole cover to match the surrounding surfaces.

INVENTION SUMMARY

It is therefore a feature of the present invention to provide a manhole access for sewers. More particularly, the present invention relates to a manhole that is adjustable in height and/or pitch to allow the top of the manhole top section to conform to the pitch of a surrounding surface, such as a road.

A further feature of the invention is to provide an adjustable manhole apparatus for positioning over a manhole extension, comprising a cover, configured to cover access to the manhole extension, and an adjuster, coupled between the cover and the manhole extension, designed to be positioned in multiple positioned that form an angle of the cover relative to a top edge of the manhole extension.

Additionally, the adjuster includes cover coupler, positioned on a top side of thereof, designed to releasably hold the cover; and manhole extension coupler, positioned on a bottom edge thereof, designed to hold the adjusting means proximate to the top edge of the manhole extension. The adjuster further includes a first position that provides for zero degrees of slope between the manhole cover and the top edge of the manhole extension; and a second position that provides for up to and including twenty degrees of slope between the manhole cover and the top edge of the manhole extension.

The adjuster further comprises a base ring, having a bottom base ring edge, designed to be rotatably and removably coupled to the manhole extension; and an angled top edge, forming an angle in the range of between two to ten degrees with the bottom base ring edge. The adjuster further comprises a rotatable ring, having a bottom edge, designed to be rotatably and removably coupled to the angled top edge of the base ring; and a angled top edge, forming an angle in the range of between two to ten degree from the bottom edge of the rotatable ring.

There has thus been outlined broadly the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
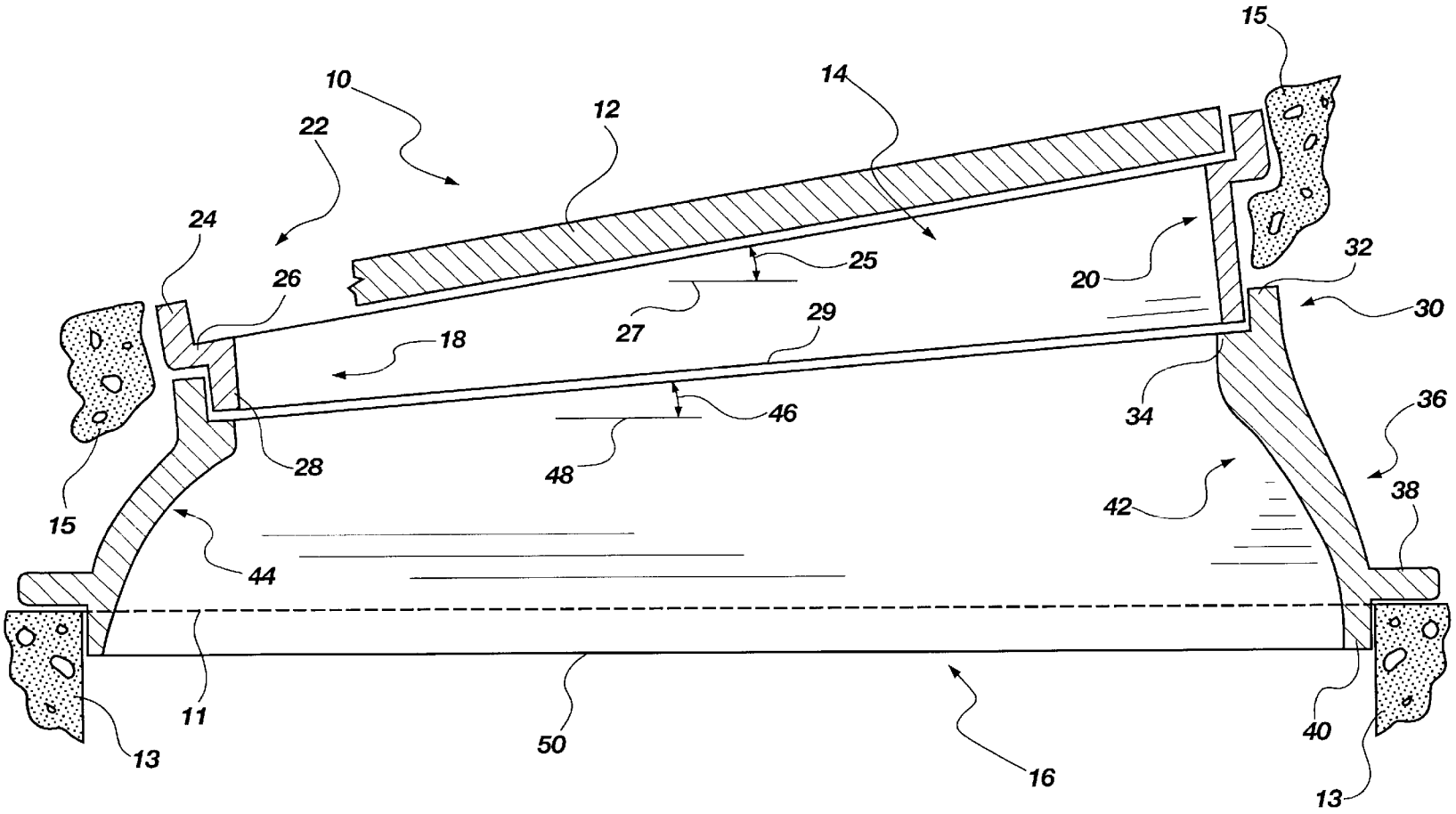
FIG. 1 is a cross-sectional side view of an embodiment of an angularly adjustable top manhole assembly.

It is noted that the drawings of the invention are not to scale. The drawings are merely schematic representations, not intended to portray specific parameters of the invention. The drawings are intended to depict only selected embodiments of the invention, and therefore should not be considered to be limiting the scope of the invention. The invention will be described with additional specificity and detail through the use of the accompanying drawings. Corresponding numbering between the figures represents corresponding elements.

DETAILED DESCRIPTION OF THE DRAWINGS

Referring to FIG. 1, a cross-sectional side view of an embodiment of the adjustable manhole insert is illustrated. Specifically, there is an angularly adjustable top manhole assembly 10. There is a manhole cover ("cover") 12 supported by a rotatable angular top ring 14, and frame or an angular base ring 16, both of which are stacked on top of a manhole extension ("extension")13 that has a manhole extension top edge 11, which is typically perpendicular to a plumb line to ensure a vertical shaft for sewer workers to climb down into. Typically, the manhole assembly 10 is surrounded by supporting ground material 15, like concrete or asphalt. Additionally, ring 14 has a height dimension that increases uniformly from a first height associated with a first side 18 and maximizes at a second height associated with a second side 20.

The ring 14 may have a coupling 22 for holding the lid 12 onto the ring 14. The coupling would typically, but not necessarily, include a lid wall 24, for holding the manhole lid 12, a shoulder 26, for supporting the lid 12, and a variable height wall 28 that uniformly increases in height from the short side 18 to the maximum height side 20. Ring 14 has a bottom edge 29 that is parallel to line 27 that illustrates angle 25 that is created from the height variation between sides 18 and 20. The created angle 25 can be between two and ten degrees, for example.

The base ring 16 includes several key features. Specifically, there is a base coupling 30 for coupling to the lower portion of ring 14. The coupling 30 may be designed with a vertical holding wall 32, for holding the ring 14 from moving off of the base ring 16, and a base coupling shoulder 34, for supporting the ring 14. There is also lower base coupling 36, for holding the base ring 16 onto the manhole extension 13. The lower base coupling 36, may include, but not be limited to, a flange or an extension 38, abutting an upper surface of the manhole extension for holding the whole adjustable ring assembly 10 on top of the extension 13, and an annular, vertical protrusion or a lower coupling wall 40, extending into the manhole extension for holding the base 16 from sliding off of the extension 13. The base ring is designed much like the top ring 14 with a shorter side 44 and a taller side 42 that forms a angle 46, that may be typically of about two to ten degrees from the base bottom wall or edge 50. It is noted that line 48 is parallel to bottom edge 50 and is positioned to illustrate the angle 46. Additionally, the bottom edge 50 is typically designed to be parallel to the top edge 11 of manhole extension 13.

REMARKS ABOUT THE PREFERRED EMBODIMENT

It is noted that one skilled in the art of designing manhole assemblies would easily understand the rotating operation of the two ring design. It should be noted however, that most all designs of manhole extensions 13 are designed with the top edge 11 to be level, or perpendicular to plumb. This is to ensure that the hole to the sewer is perpendicular to the sewer lines. Uniquely, a maximum amount of pitch to the cover 12 is achieved by placing the shortest sections 18 and 44 upon each other, as currently illustrated, which will position the largest ends 20 and 42 upon each other. Additionally, it is equally understandable to skilled artisans that it is possible to have cover 12 in a zero pitch, or zero degree slope. This is accomplished by having if the largest and smallest thickness sections 18 and 42, and 20 and 44, stacked above each other. Specifically, the angle achieved by the one ring would be off set by the opposite angle provided by the other ring.

It is further noted that each ring section is designed to withstand the full weight of any passing vehicle. These sections are desired to be made of cast iron or other strong materials. They are designed to be sold in combination and are not made to be separate from each other.

VARIATIONS OF THE PREFERRED EMBODIMENT

One skilled in the art would be capable of making many obvious design changes which would stay within the scope of the invention disclosed in this application. It is noted that cement extension 13 is illustrated as having no groove therein to accommodate the insertion of the base ring 16. However, it is also understood that there are many ways to place the lower ring 16 over the extension 13. For example, ring 16 could be bolted thereon, or even threaded to the extension 13.

Numerous modifications and alternative arrangements can be devised by those skilled in the art without departing from the spirit and scope of the present invention, and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function, manner of operation, assembly, and use may be made without departing from the principles and concepts set forth herein.

What is claimed is:

1. An adjustable manhole apparatus, comprising:

a) a manhole extension including an upper surface with an opening therein;

b) a frame, directly disposed on the manhole extension and rotatable with respect thereto, including:
   1) a bottom edge, designed to be rotatably disposed on the manhole extension;
   2) an angled top edge, forming an angle between approximately two to ten degrees with the bottom edge;
   3) a flange, extending outwardly from the bottom edge and abutting the upper surface of the manhole extension to support the frame on the manhole extension; and
   4) an annular protrusion, extending vertically downwardly from the bottom edge and extending into the opening of the manhole extension to resist lateral movement of the frame with respect to the manhole extension;

c) a single rotatable ring, rotatably disposed on the frame, having:
   1) a bottom edge, designed to be rotatably disposed on the angled top edge of the frame; and
   2) a angled top edge, forming an angle between approximately two to ten degrees from the bottom edge of the rotatable ring; and d) a cover, removably disposed directly on the rotatably ring, to cover access to the manhole extension.

2. An adjustable manhole apparatus, comprising:

a) a manhole extension including an upper surface with an opening therein;

b) a frame, directly disposed on the manhole extension and rotatable with respect thereto, including:
   1) a bottom edge, designed to be rotatably disposed on the manhole extension;
   2) a flange, extending outwardly from the bottom edge and abutting the upper surface of the manhole extension to support the frame on the manhole extension;
   3) an annular protrusion, extending vertically downwardly from the bottom edge and extending into the opening of the manhole extension to resist lateral movement of the frame with respect to the manhole extension;
   4) an angled top edge, forming an angle between approximately two to ten degrees with the bottom edge;
   5) a shoulder, formed at the angled top edge; and
   6) a vertical wall, surrounding the shoulder;

c) a single rotatable ring, rotatably disposed on the base ring, having:
   1) a bottom edge, designed to be rotatably disposed on the shoulder of, and between the vertical wall of, the angled top edge of the frame; and
   2) a angled top edge, forming an angle between approximately two to ten degrees from the bottom edge of the rotatable ring;
   3) a shoulder, formed at the angled top edge of the rotatable ring; and
   4) a vertical wall, surrounding the shoulder of the rotatable ring; and d) a cover, removably disposed directly on the shoulder of, and between the vertical wall of, the rotatably ring, to cover access to the manhole extension.

* * * * *